US005744740A

United States Patent [19]

Mizuno

[11] Patent Number: 5,744,740

[45] Date of Patent: Apr. 28, 1998

[54] ELECTRONIC MUSICAL INSTRUMENT

[75] Inventor: Kotaro Mizuno, Hamamatsu, Japan

[73] Assignee: Yamaha Corporation, Japan

[21] Appl. No.: 604,348

[22] Filed: Feb. 21, 1996

[30] Foreign Application Priority Data

Feb. 24, 1995 [JP] Japan ..... 7-036427

[51] Int. Cl.[6] ..... G10H 1/18

[52] U.S. Cl. ..... 84/615; 84/622; 84/645

[58] Field of Search ..... 84/615, 618, 616, 84/622, 645, 477 R, 478

[56] References Cited

U.S. PATENT DOCUMENTS

| | | | |
|---|---|---|---|
| 5,278,348 | 1/1994 | Eitaki et al. | 84/636 |
| 5,298,675 | 3/1994 | Nishimoto et al. | 84/622 |
| 5,471,008 | 11/1995 | Fujita et al. | 84/633 |

*Primary Examiner*—William M. Shoop, Jr.
*Assistant Examiner*—Marlon T. Fletcher
*Attorney, Agent, or Firm*—Graham & James LLP

[57] ABSTRACT

An electronic musical instrument cooperates with a MIDI instrument to generate musical tones in a desired manner which is arbitrarily set by a human operator. The electronic musical instrument has a plurality of MIDI channels for receiving performance data from the MIDI instrument as well as a memory, a keyboard, a visual display section and panel switches. The human operator manually operates the panel switches to designate functions, which can be adjusted or changed by the MIDI instrument during progression of musical performance played by the keyboard of the electronic musical instrument. For this reason, at least one MIDI channel is used to control the panel control event. The memory stores information representing relationship between note numbers, panel control events and the functions. The human operator is capable of editing content of the information, stored by the memory, in cooperation with the visual display section such that a panel control event, together with two functions, are assigned to a desired note number and a manner of execution of the two functions is arbitrarily set. Thus, the setting of the electronic musical instrument can be easily adjusted or changed by the MIDI instrument during progression of the musical performance.

13 Claims, 8 Drawing Sheets

RCV

| MIDI CH | PART |
|---|---|
| 1 | RIGHT |
| 2 | RIGHT |
| 3 | RIGHT |
| 4 | RIGHT |
| 5 | LEFT |
| 6 | LEFT |
| 7 | LEFT |
| 8 | LEFT |
| 9 | LEAD |
| 10 | LEAD |
| 11 | LEAD |
| 12 | LEAD |
| 13 | ABC |
| 14 | ABC |
| 15 | ABC |
| 16 | PANEL |

FIG.2A

EVENT

| NN | KC | EC |
|---|---|---|
| 36 | C 1 | 1 |
| 37 | C#1 | 0 |
| 38 | D 1 | 4 |
| 39 | D#1 | 0 |
| 40 | E 1 | 5 |
| 41 | F 1 | 6 |
| 42 | F#1 | 0 |
| 43 | G 1 | 0 |
| 44 | G#1 | 0 |
| 45 | A | 11 |
| 46 | A#1 | 0 |
| 47 | B 1 | 12 |
| 48 | C 2 | 13 |
| 49 | C#2 | 0 |

FIG.2B

| EC | NAME | TYPE | STATE1 | STATE2 |
|---|---|---|---|---|
| 1 | START/STOP | 2 | START | STOP |
| 2 | REGIST+ | 1 | REGIST+ | |
| 3 | REGIST- | 1 | REGIST- | |
| 4 | INTRO A/FILL IN1 | 1 | INTRO A/FULL IN1 | |
| 5 | INTRO B/FILL IN2 | 1 | INTRO B/FULL IN2 | |
| 6 | ENDING/ret. | 1 | ENDING/ret. | |
| 7 | FINGERD CHORD 1/2 | 2 | CHORD1 | CHORD2 |
| 8 | HARMONY ON/OFF | 2 | ON | OFF |
| 9 | BREAK | 1 | BREAK | |
| 10 | FADE IN/OUT | 1 | FADE IN/OUT | |
| 11 | SUSTAIN | 3 | SUSTAIN ON | SUSTAIN OFF |
| 12 | SOSTENUTE | 3 | SOSTENUTE ON | SOSTENUTE OFF |
| 13 | SOFT | 3 | SOFT ON | SOFT OFF |
| 14 | ABC ON/OFF | 2 | ON | OFF |
| 15 | RHYTHM PART ON/OFF | 2 | ON | OFF |
| 16 | BASS PART ON/OFF | 2 | ON | OFF |
| 17 | CHORD PART ON/OFF | 2 | ON | OFF |
| 18 | TEMPO+ | 1 | TEMPO+ | |
| 19 | TEMPO- | 1 | TEMPO- | |

FIG.2C

ELECTRONIC MUSICAL INSTRUMENT

BACKGROUND OF THE INVENTION

1. Field of the Invention

The invention relates to electronic musical instruments which are capable of adjusting functions thereof and/or changing the setting thereof by manipulating manual operable members such as panel switches.

2. Prior Art

Electronic musical instruments, which are currently put into practical use, have many functions; therefore, a variety of manual operable members, such as controls and switches, are required to adjust the functions and/or changing the setting. For example, console-type electronic musical instruments such as electronic organs provide plenty of panel switches which are arranged on a console thereof to adjust the functions and/or change the setting. As for keyboard-type electronic musical instruments such as synthesizers, space for an operation panel should be limited; therefore, it is difficult to provide plenty of panel switches. For this reason, switches are put into hierarchization so that many functions can be realized by a relatively small number of switches.

In the console-type electronic musical instruments, arrangement of panel switches is determined such that the panel switches can be visually recognized by a human operator with ease. Actually, however, so many key switches are arranged on a console of the electronic musical instrument. Therefore, it is difficult for the human operator to grasp operations of the panel switches; and the human operator requires high-level skills to manipulate certain switches speedily during progression of musical performance. If a switch is put into hierarchization so that a plurality of functions are assigned to the switch, certain number of switching operations should be made to designate a desired function. In other words, relatively long time is required to designate the desired function; and consequently, it is difficult for the human operator to manipulate the switches in real time. As described above, any of the electronic musical instruments conventionally known cannot offer real-time manipulation of the switches for the human operator during progression of the musical performance.

By the way, some improvement can be proposed for the electronic musical instruments to enable the real-time manipulation of the switches. For example, an external device is provided to set functions of key switches only, wherein the key switches should be manipulated during progression of the musical performance. In that case, real-time manipulation of the key switches can be achieved by operating the external device. In order to do so, both of the electronic musical instrument and external device should provide functions to receive and transmit data which are used to execute the functions of the key switches. However, a data format for the data is not regulated by MIDI standard (wherein 'MIDI' is an abbreviation for 'Musical Instrument Digital Interface'). For this reason, the data should be described by so-called "system exclusive message". In that sense, functions of receiving and transmitting the data are not general-purpose functions which can be generally shared between different types of devices or between different manufacturers. In other words, the aforementioned external device is specifically used for its corresponding electronic musical instrument only. So, the external device cannot be used for general purpose; and manufacturing of such an external device is an un-economical way for the manufacturer.

SUMMARY OF THE INVENTION

It is an object of the invention to provide an electronic musical instrument which is capable of adjusting functions thereof and/or changing the setting thereof by a general-purpose communication of data from an external device.

The invention offers a brand-new electronic musical instrument which generates musical tones in a desired manner, which is arbitrarily set by a human operator, in cooperation with a MIDI instrument. The electronic musical instrument has a plurality of MIDI channels for receiving performance data from the MIDI instrument as well as a memory, a keyboard, a visual display section and panel switches. Herein, the performance data are made in a known MIDI format. The MIDI instrument is provided to control functions of the electronic musical instrument.

The human operator manually operates the panel switches to designate the functions, which can be adjusted or changed by the MIDI instrument during progression of musical performance played by the keyboard of the electronic musical instrument. For this reason, at least one MIDI channel is used to control a panel control event.

The memory stores information representing relationship between note numbers, panel control events and the functions. The human operator is capable of editing content of the information, stored by the memory, in cooperation with the visual display section such that a panel control event, together with two functions, are assigned to a desired note number. Further, a manner of execution of the two functions can be arbitrarily set by the human operator. For example, only one function is executed responsive to a note-on event; the two functions are alternatively executed responsive to a note-on event; or one function is executed responsive to a note-on event whilst another function is executed responsive to a note-off event.

BRIEF DESCRIPTION OF THE DRAWINGS

These and other objects of the subject invention will become more fully apparent as the following description is read in light of the attached drawings wherein:

FIGS. 2A to 2C show contents of tables;

DESCRIPTION OF THE PREFERRED EMBODIMENT

Figure 1A:
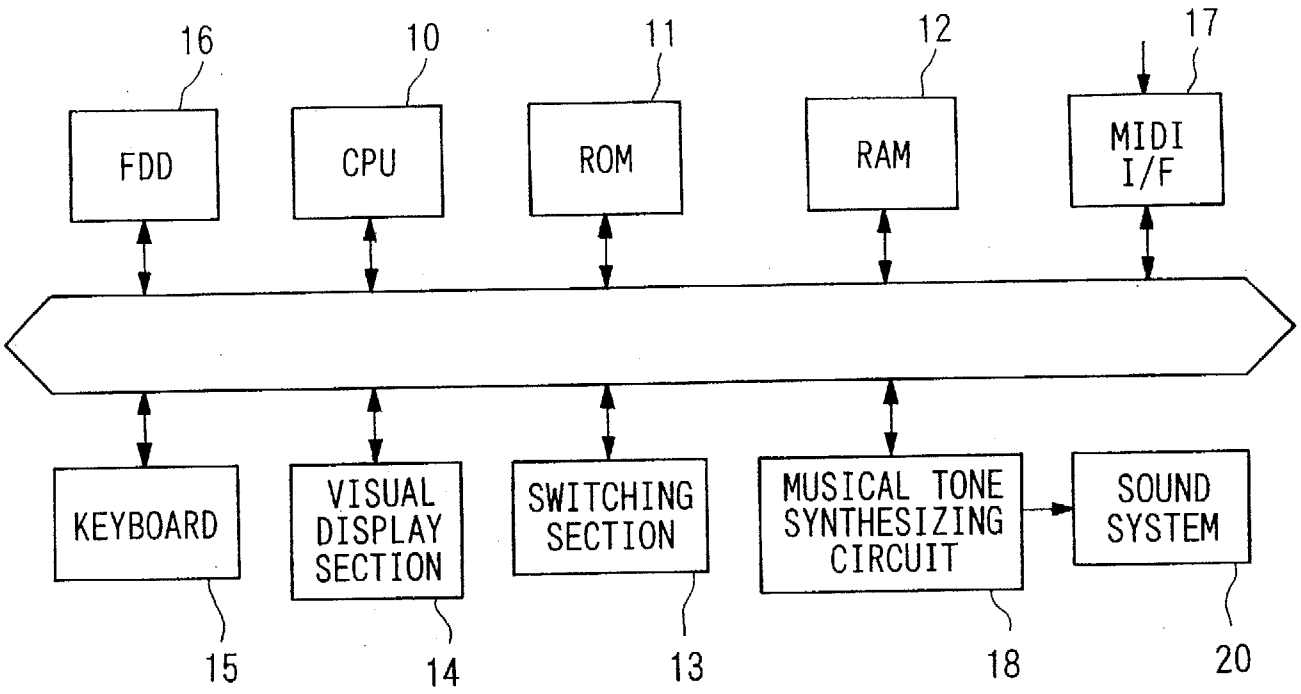
FIG. 1A is a block diagram showing an overall configuration of an electronic musical instrument which is designed in accordance with a first embodiment of the invention.
Figure 1B:
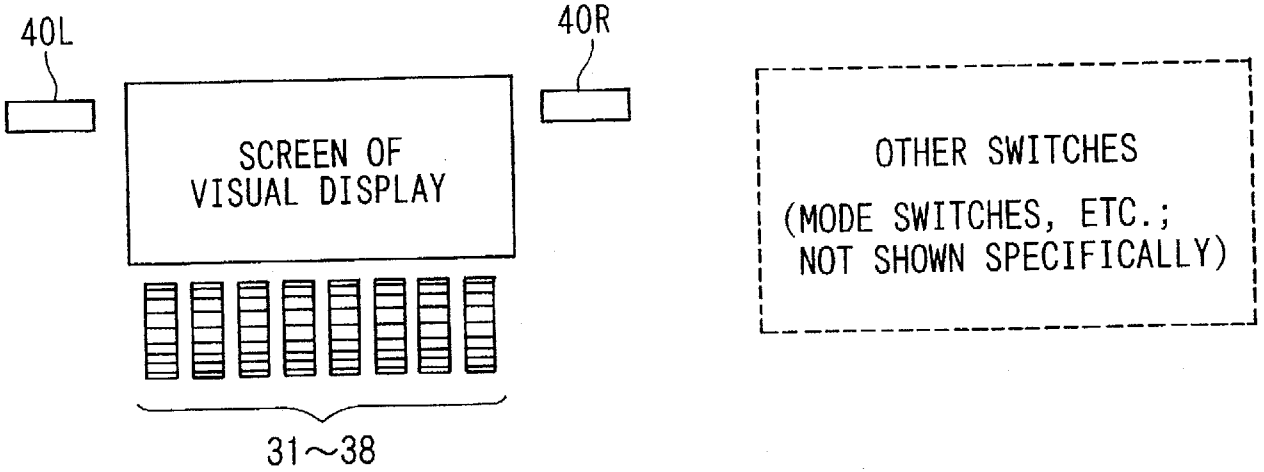
FIG. 1B is a plan view showing a selected part of a face of an operation panel of the electronic musical instrument.
Figure 3A:
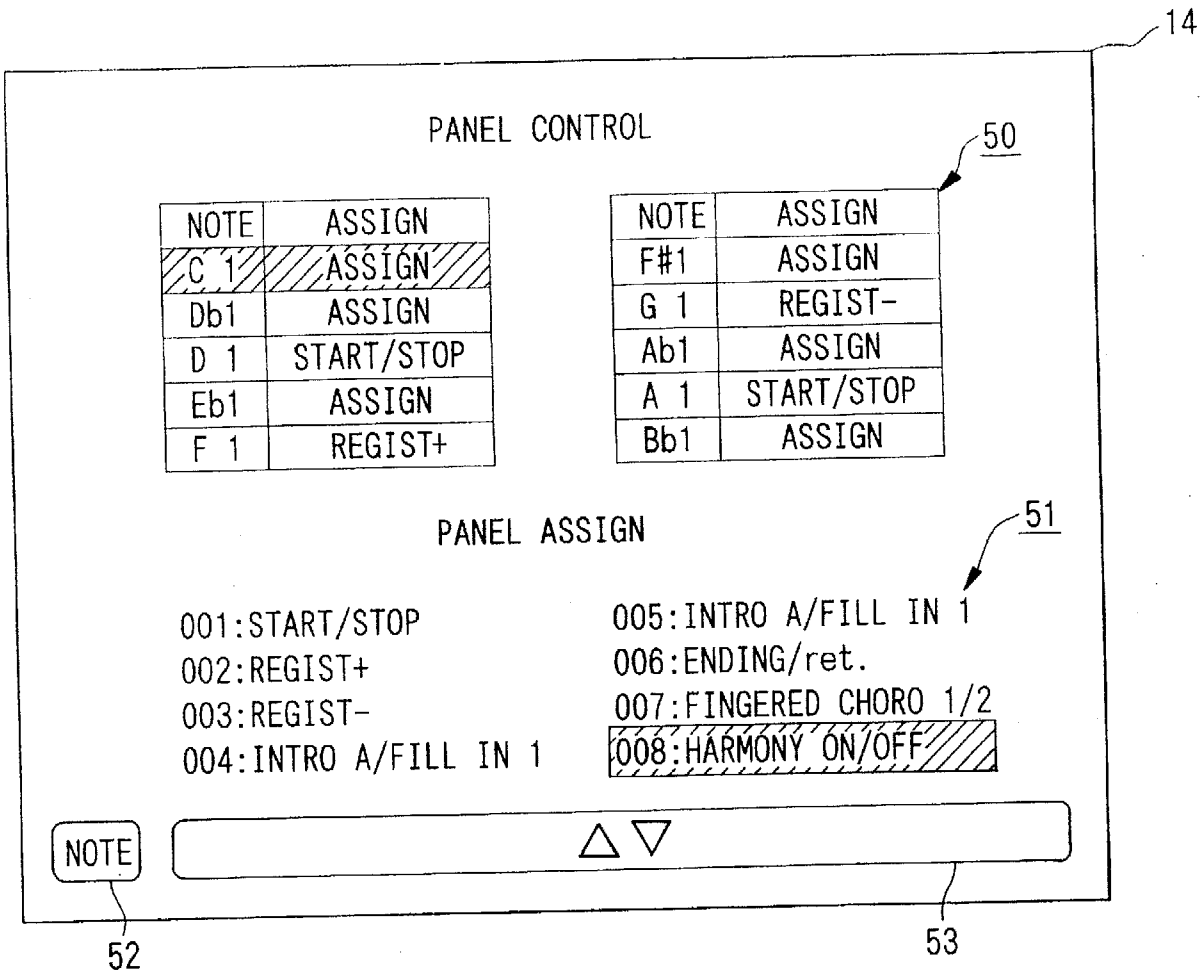
FIG. 3A shows an example of a screen image which is visually displayed for a human operator of the electronic musical instrument.

FIG. 1A is a block diagram showing an overall configuration of an electronic musical instrument which is designed in accordance with an embodiment of the invention; and FIG. 1B is a plan view showing a selected part of a face of an operation panel of the electronic musical instrument. In FIG. 1A, a CPU 10 is provided to control operations of the electronic musical instrument as a whole; and the CPU 10 is connected to a ROM 11, a RAM 12, a switching section 13, a visual display section 14, a keyboard 15, a floppy-disk drive 16, a MIDI interface 17 and a musical tone synthesizing circuit 18 through a bus. The ROM 11 stores control programs, as shown by flowcharts of FIGS. 4 and 5, as well as sequence programs which are used to execute automatic performance and automatic accompaniment using auto bass chords (ABC). In addition, a variety of tables and registers, as shown by FIGS. 2A to 2C, are set in the RAM 12. In FIG. 1B, function switches 40L and 40R are placed to sandwich a screen of the visual display section 14; and rotary encoders 31 to 38 are placed below the screen. The switching section 13 contains the function switches 40L, 40R and the rotary encoders 31 to 38. The screen of the visual display section 14 is placed approximately center of the face of the operation panel. The visual display section 14 visually displays a certain screen image in response to an operation mode which is currently designated. FIG. 3A shows an example of the screen image. The visual display section 14 is configured as a liquid-crystal-type matrix display.

Now, certain functions are assigned to the function switches 40L, 40R and the rotary encoders 31 to 38. The functions assigned to them differ with respect to each operation mode. If a certain operation mode is designated, functions are correspondingly displayed by the screen of the visual display section 14. Incidentally, the switching section 13 contains other switches such as mode switches; however, those switches do not directly relate to the invention; hence, specific illustration thereof is omitted in FIG. 1B.

The keyboard 15 has a certain scale which corresponds to five octaves or so. An overall range of the keyboard 15 is divided into two sections, i.e., a right register and a left register, tone colors of which are designated by symbols 'RIGHT' and 'LEFT' respectively. Different tone colors can be assigned to those registers respectively. If a key which belongs to the right register is depressed, a musical tone is produced in tone color, which is assigned to the right register, and in tone pitch (i.e., note number) which corresponds to the key depressed. Similarly, if a key which belongs to the left register is depressed, a musical tone is produced in tone color, which is assigned to the left register, and in tone pitch which corresponds to the key depressed. However, if note-on data are inputted through the MIDI interface 17, assignment of tone colors for the register is neglected, so that musical tones are produced in a same tone color, which is assigned to a receiving MIDI channel, with respect to data of any note numbers. A floppy disk, in which sequence data are written, is inserted into the floppy disk drive 16. A MIDI device such as a MIDI keyboard can be connected to the MIDI interface 17. Data communication is made based on a MIDI format between the MIDI device and the electronic musical instrument of FIG. 1A through the MIDI interface 17. As the MIDI device which is connected to the MIDI interface 17, there is provided a sequencer other than the MIDI keyboard. The musical tone synthesizing circuit 18 synthesizes musical tone signals based on note-on events which are inputted thereto by the keyboard 15 or the MIDI interface 17. In addition, the musical tone synthesizing circuit 18 synthesizes rhythm sound, chord sound and bass sound based on ABC programs. Musical tone signals, which are created in a digital form by the musical tone synthesizing circuit 18, are supplied to a sound system 20. In the sound system 20, the musical tone signals are converted into analog signals which are then amplified, so that corresponding musical tones are produced.

FIGS. 2A to 2C show tables which are set in the RAM 12. Herein, FIG. 2A shows content of a receiving-MIDI-channel assignment table which is designated by a symbol 'RCV'; FIG. 2B shows content of an event assignment table which is designated by a symbol 'EVENT'; and FIG. 2C shows content of a panel-control-event table.

The receiving-MIDI-channel assignment table RCV of FIG. 2A is used to designate instructions for the electronic musical instrument, wherein the instructions are determined based on performance data which are received by MIDI channels. The electronic musical instrument provides sixteen MIDI channels, serial numbers of which range from 'CHANNEL 1' to 'CHANNEL 16'. In an example of the content of the table RCV shown by FIG. 2A, a tone color 'RIGHT' for the right register is assigned to four MIDI channels which range from CHANNEL 1 to CHANNEL 4; a tone color 'LEFT' for the left register is assigned to four MIDI channels which range from CHANNEL 5 to CHANNEL 8; a lead tone color, which is designated by a symbol 'LEAD', is assigned to four MIDI channels which range from CHANNEL 9 to CHANNEL 12; an ABC function, which is designated by a symbol 'ABC', is assigned to three MIDI channels which range from CHANNEL 13 to CHANNEL 15; and a panel-control function, which is designated by a symbol 'PANEL', is assigned to CHANNEL 16. Therefore, if note-on event data are supplied to some MIDI channel which exists between CHANNEL 1 and CHANNEL 4, the electronic musical instrument produces a musical tone in the tone color RIGHT on the basis of a note number corresponding to the note-on event data. If note-on event data are supplied to some MIDI channel which exists between CHANNEL 5 and CHANNEL 8, the electronic musical instrument produces a musical tone in the tone color LEFT on the basis of a note number corresponding to the note-on event data. Further, if note-on event data are supplied to some MIDI channel which exists between CHANNEL 9 and CHANNEL 12, the electronic musical instrument produces a musical tone in the lead tone color LEAD on the basis of a note number corresponding to the note-on event data. Herein, the lead tone color LEAD is designated to conduct melody performance. So, the right register is automatically controlled such that a highest-pitch sound thereof will be produced in this tone color. If note-on event data are supplied to some MIDI channel which exists between CHANNEL 13 and CHANNEL 15, the electronic musical instrument detects a chord based on combination of note numbers which are currently subjected to note-on events. So, the electronic musical instrument executes an ABC program based on the chord detected.

Moreover, if data representing a note-on event or a note-off event are supplied to CHANNEL 16, the electronic musical instrument refers to the event assignment table EVENT (see FIG. 2B) so as to execute a panel control event in response to a note number corresponding to the data.

The MIDI interface 17 is designed to receive a certain range of note numbers which ranges from '0' to '127'. In FIG. 2B, the note number is designated by a symbol 'NN'. The event assignment table EVENT of FIG. 2B copes with a general range of keys of a MIDI keyboard; in other words, the table copes with a general range of note numbers which range from '36(C1)' to '96(C6)', wherein this range corresponds to note numbers which the MIDI keyboard can transmit. The table EVENT is used to assign a panel control event to each of the note numbers which belong to the general range. As shown by the table of FIG. 2C, there are provided nineteen kinds of panel control events which are designated by a symbol 'EC' (indicating an event code), wherein EC ranges from '1' to '19'. Each of the panel control events, which range from 'EC=1' to 'EC=19', can be assigned to any one of the note numbers. In addition, it is possible to assign a single panel control event to a plurality of note numbers; or it is possible to assign a plurality of panel control events to two note numbers. If a single panel control event is assigned to a plurality of note numbers, the panel control event can be executed when some note event (e.g., note-on event or note-off event) is inputted with respect to any one of the note numbers. If a plurality of panel control events are assigned to a single note number, the panel control events are simultaneously executed when some note event is inputted with respect to the note number. Incidentally, 'EC=0' in the table EVENT of FIG. 2B indicates that no panel control event is assigned to a note number corresponding to 'EC=0'.

In the panel-control-event table of FIG. 2C, there are provided nineteen event codes 'EC' which range from '1' to '19'. The table stores information which relates to a name of an event (NAME), a type (TYPE), a function of 'STATE1' and a function of 'STATE2' with respect to each of the event codes which range from 'EC=1' to 'EC=19'. In addition, there are provided three types for the panel control event, wherein the three types are designated by numbers '1', '2' and '3' respectively. Each type defines a manner of execution of the functions of STATE1 and STATE2, as follows:

(a) TYPE=1

When a note-on event occurs with respect to a certain note number, function of STATE1, which is assigned to an event code EC (i.e., panel control event) corresponding to TYPE=1, is executed. For this reason, only the function of STATE1 is assigned to the panel control event corresponding to TYPE=1. The table of FIG. 2C contains a certain number of panel control events, each of which corresponds to TYPE=1, as follows:

EC=2: Addition of 1 to REGIST number

EC=3: Subtraction of 1 from REGIST number

The electronic musical instrument stores multiple kinds of switch-set patterns (or registrations) for the instrument as a whole, so that read-out of the switch-set pattern is designated by the registration number.

EC=4: Execution of 'INTRO A' or 'FILL IN1'.

EC=5: Execution of 'INTRO B' or 'FILL IN2'.

Before an automatic performance is started, an intro pattern is executed; and then, the automatic performance is started. In the middle of the automatic performance, a fill-in pattern is inserted.

EC=6: Execution of an ENDING pattern or a return pattern.

EC=9: Execution of BREAK (i.e., non-sound interval which corresponds to one measure or so).

EC=10: Execution of 'FADE IN/OUT'.

EC=18: Addition of 1 to TEMPO.

EC=19: Subtraction of 1 from TEMPO.

(b) TYPE=2

Every time a note-on event occurs with respect to a certain note number, function of STATE1 and function of STATE2, which are assigned to an event code EC (i.e., panel control event) corresponding to TYPE=2, are alternatively executed. The table of FIG. 2C contains a certain number of panel control events, each of which corresponds to TYPE=2, as follows:

EC=1: START and STOP for automatic performance.

EC=7: F0320SettingforfingerCHORD1and finger CHORD2.

Herein, the finger CHORD1 indicates a method of designation of a chord using three fingers; and the finger CHORD2 indicates a method of designation of a chord using one finger. Those methods are alternatively changed over.

EC=8: ON or OFF for HARMONY function.

The HARMONY function is a function by which high-degree sound, which is higher than sound of melody by three degrees, is automatically performed, for example.

EC=14: ON or OFF for ABC function.

EC=15: ON or OFF for RHYTHM PART.

EC=16: ON or OFF for BASS PART.

EC=17: ON or OFF for CHORD PART.

(c) TYPE=3

As for a panel control event which corresponds to TYPE=3, function of STATE2 is set in a note-on period of time, which is measured between a note-on event and a note-off event; and function of STATE1 is set in a note-off period of time. That is, the function of STATE2 is set at the note-on event whilst the function of STATE1 is set at the note-off event. This type of panel control events corresponds to functions of pedals or push-button switches. The table of FIG. 2C contains this type of panel control events, as follows:

EC=11: ON and OFF for SUSTAIN function.

EC=12: ON and OFF for SOSTENUTE.

EC=13: ON and OFF for SOFT function.

Figure 3B:
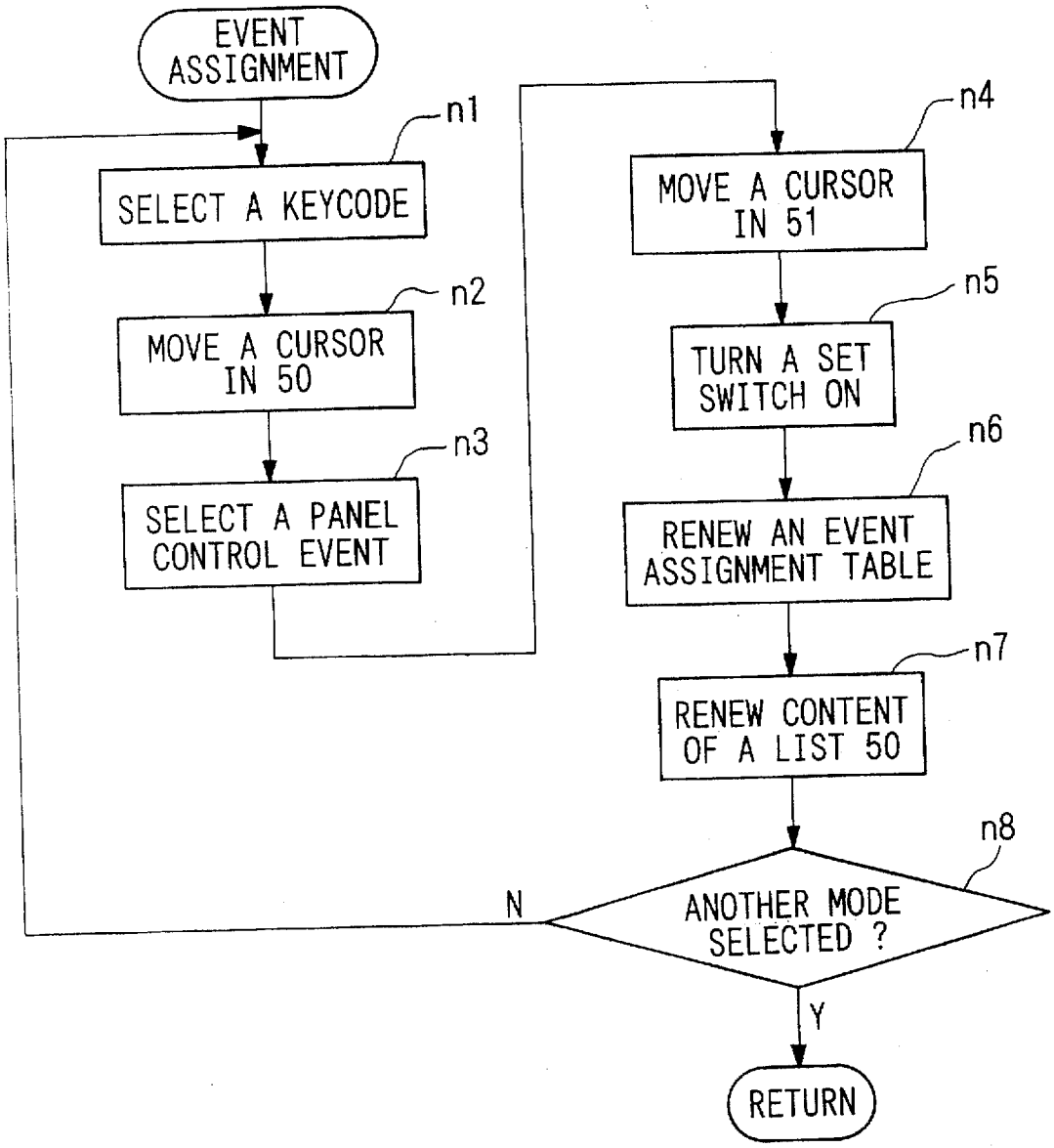
FIG. 3B is a flowchart showing a sequence for assignment between a note number and a panel control event in conjunction with FIG. 3A.

Next, setting operation for the event assignment table EVENT of FIG. 2B will be described with reference to FIGS. 3A and 3B. FIG. 3A shows an example of a screen image which is visually displayed on screen by the visual display section 14 at an event assignment mode. Basically, the screen image consists of three sections which are arranged in vertical direction. Herein, a first section, which is designated by a numeral '50', contains two lists each of which shows relationship between a keycode and a panel control event. Those lists are capable of showing ten keycodes which are selected from among keycodes (e.g., C1 to C5) corresponding to note numbers 36 to 96 (see FIG. 2B). So, each block, disposed below a column entitled 'NOTE', displays a keycode, while each block, disposed below a column entitled 'ASSIGN', displays a panel control event which corresponding to the keycode. A second section, which is designated by a numeral '51', displays eight names of panel control events which are assigned to eight event codes '001' to '008', for example. Further, a third section, which contains two portions 52 and 53, displays functions of the rotary encoders 31 to 38. According to the current content of the third section, function of selecting a note number (or a keycode) is assigned to the rotary encoder 31. So, if the rotary encoder 31 is manually operated to rotate upward, a cursor (i.e., enhanced part), shown in the list of the first section 50, is moved upwardly so that the note number selected is changed to a lower note number. If the rotary encoder 31 is manually operated to rotate downward, the cursor is moved downwardly so that the note number selected is changed to a higher note number. Moreover, function of selecting a panel control event is assigned to each of the other rotary encoders 32 to 38. If one of them is manually operated to rotate in a direction, a cursor (i.e., enhanced part), shown in the second section 51, is moved in that direction so that a panel control event selected is changed to a desired one. Thus, if a SET switch (not shown) is turned 'ON' after the rotary encoder 31 is operated to designate a desired note number and one of the rotary encoders 32 to 38 is operated to designate a desired panel control event, assignment can be completed between the desired panel control event and the desired note number.

Next, a sequence for the aforementioned assignment will be described with reference to a flowchart of FIG. 3B. This flowchart does not show merely a part of processing of the CPU 10; but it shows relationship between the processing of the CPU 10 and manual operations made by a human operator. At first, the human operator manually operates the rotary encoder 31 to designate a note number, to which a certain panel control event should be assigned, in step n1. The CPU 10 controls the visual display section 14 to move a cursor, shown in the list of the first section 50, in response to manual operation of the rotary encoder 31 in step n2. In step n3, the human operator conducts a manual operation for one of the rotary encoders 32 to 38 to select a panel control event which should be assigned to the note number designated. The CPU 10 controls the visual display section 14 to move a cursor, shown in the second section 51, in response to the manual operation in step n4. Next, the human operator operates the SET switch 'ON' in step n5. In response to 'ON' state of the SET switch, the CPU 10 controls writing of the event assignment table EVENT of FIG. 2B such that an event number (i.e., an event code) corresponding to the panel control event selected is written into a block, which corresponds to the note number designated, within a column of 'EC' in the table EVENT in step n6. Thus, assignment between the note number and panel control event is completed. In step n7, content of the assignment is displayed in the list of the first section 50. A sequence of operations described above can be repeated if the event assignment mode is sustained, in other words, until step n8 makes a decision that another mode is selected.

Figure 4:
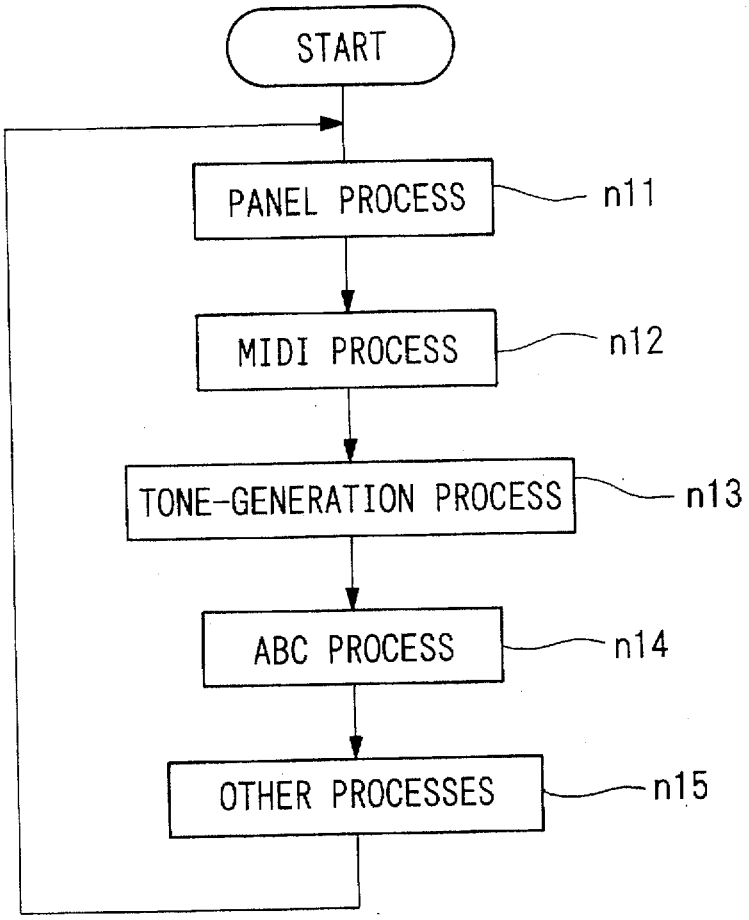
FIG. 4 is a flowchart showing a main routine which is executed by the electronic musical instrument.
Figure 5:
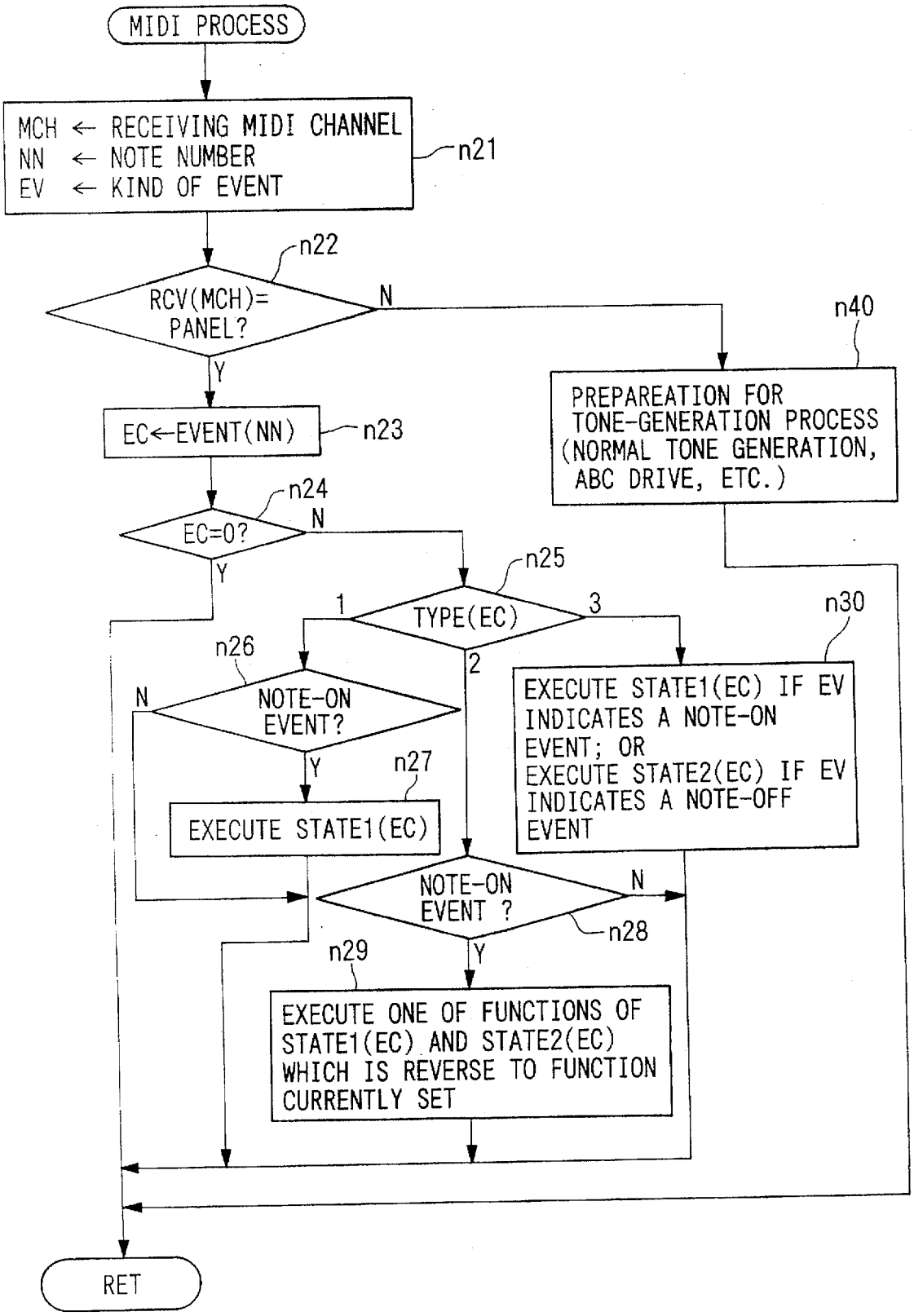
FIG. 5 is a flowchart showing details of a MIDI process which is executed by the electronic musical instrument.

FIGS. 4 and 5 are flowcharts showing operations of the electronic musical instrument of FIG. 1.

FIG. 4 shows a main routine. If the electronic musical instrument works in a normal state, the electronic musical instrument repeatedly executes panel process (step n11), MIDI process (step n12), tone-generation process (step n13), ABC process (step n14) and other processes (step n15). In the panel process, the electronic musical instrument performs visual display and/or scanning of panel switches. In the MIDI process, the electronic musical instrument processes MIDI data which are inputted from a MIDI instrument through the MIDI interface 17. Details of the MIDI process will be described later in conjunction with FIG. 5. In the tone-generation process, the electronic musical instrument synthesizes musical tones in response to key-on events of the keyboard 15 or normal note events which are inputted thereto through the MIDI interface 17. In the ABC process, the electronic musical instrument produces automatic-accompaniment sound (i.e., bass sound, chords and rhythm sound) at a certain tempo in accordance with accompaniment patterns, chords and rhythm which are designated. In the other processes, adjustment for a main volume is conducted, for example.

The flowchart of FIG. 5 shows the details of the MIDI process. In first step n21, a receiving channel for MIDI data inputted is stored by a receiving-MIDI-channel register 'MCH'; a note number received is stored by a note-number register 'NN'; and a kind of an event is stored by an event-kind register EV. In step n22, the CPU 10 performs searching, using MCH, on the receiving-MIDI-channel assignment table RCV to decide whether or not a relationship of "RCV(MCH)=PANEL" is established. In other words, the step n22 makes a decision as to whether or not 'PANEL' is assigned to the receiving MIDI channel. That is, the step n22 makes a decision as to whether or not the current receiving MIDI channel is CHANNEL 16 in the table RCV of FIG. 2A. If this condition is satisfied, the CPU 10 proceeds to step n23. If not, the CPU 10 proceeds to step n40 wherein preparation for normal tone-generation is carried out. In the step n40, a tone-generation task is assigned to a tone-generation channel which is selected from among multiple tone-generation channels; thereafter, a keycode, corresponding to the content of the note number register NN, and a tone-color number are sent to the tone-generation channel. If ABC function is assigned to the tone-generation channel, a kind of chord is figured out for the tone-generation channel.

In step n23, the CPU 10 performs searching on the event assignment table EVENT using the note number NN so as to figure out an event code EC. If the event code EC is equal to '0', no panel control event is assigned to the note number NN. So, such an event code is neglected, so that processing of the CPU 10 passes through step n24. If the event code is not equal to '0', the CPU 10 proceeds to step n25 wherein the CPU 10 performs searching, using the event code, to find out a panel control event. Thus, the CPU 10 reads out a type of the event code. If TYPE=1, the CPU 10 carries out steps n26 and n27. Herein, the CPU 10 executes function of STATE1 (which is designated by 'STATE1(EC)' in the step n27) based on a condition (described by the step n26) where content of the event-kind register EV, which stores a kind of an event inputted, indicates a note-on event. If TYPE=2, the CPU 10 carries out steps n28 and n29. Herein, the CPU 10 executes one of functions of STATE1 and STATE2, which is different from function currently set, based on a condition (described by the step n28) where the content of the event-kind register EV indicates a note-on event. If TYPE=3, the CPU 10 proceeds to step n30. Herein, the CPU 10 executes the function of STATE1 if the register EV indicates a note-on event, whilst the CPU 10 executes the function of STATE2 if the register EV indicates a note-off event.

As described above, the present embodiment is capable of performing a variety of panel control events based on a kind of a note event (i.e., a note-on event or a note-off event) which is received by CHANNEL 16 of the MIDI interface 17. In general, most of the MIDI instruments are capable of outputting note events based on MIDI standard; and data representing the note events are made in a MIDI format which is standardized. In other words, such a data format is same, regardless of difference of manufacturers which manufacture the MIDI instruments. So, if there is provided a single MIDI instrument, which is not used for musical performance, other than a music keyboard used for the musical performance, the MIDI instrument can be used as a panel-control keyboard used for panel control in real time. In that case, it is possible to change over functions of the electronic musical instrument by operating the panel-control keyboard while carrying out the musical performance by the music keyboard.

The present embodiment described above is designed such that if note event data are received, the note event data are converted into panel control events. Such a conversion function can be reversed. That is, it is possible to store a panel control sequence in a format which is similar to that of automatic performance data. In that case, if the electronic musical instrument executes functions of STATE1 and STATE2, in the panel-control-event table, in response to operations for panel switches, the electronic musical instrument reversely refers to the aforementioned panel-control-event table and event assignment table so as to output a note event from a MIDI channel to which 'PANEL' is assigned. This note event can be recorded as a normal MIDI event by a sequencer (which acts as a performance data recording device and/or an automatic performance device) and the like. Therefore, if a series of operations for the panel switches are generated as note events in accordance with method described above so that the note events are recorded in the sequencer, the note events recorded are regenerated and are input through the MIDI channel to which 'PANEL' is assigned. Thus, the series of operations for the panel switches can be automatically realized by the electronic musical instrument.

In addition, the present embodiment can be modified such that if a letter '–' (i.e., a symbol of minus) is added to an event code which is written into the event assignment table, a panel control event, corresponding to the event code, is subjected to reverse interpretation wherein functions of STATE1 and STATE2 are reversely executed. This modification realizes that if multiple panel control events are provided with respect to a single note number, the multiple panel control events can function reversely with each other in response to the single note number. For example, if function of SUSTAIN is ON, function of SOSTENUTE is OFF; or if the function of SUSTAIN is OFF, the function of SOSTENUTE is ON.

As described heretofore, the present embodiment is designed such that a certain panel control event is executed based on a note number corresponding to occurrence of a note-on event or a note-off event. However, kinds of MIDI data which can be used by the invention are not limited to note event data representing the note-on event or note-off event. In other words, the invention can use another kinds of MIDI data such as after-touch data and control change data. In addition, the present embodiment can be further modified such that in case of a note-on event, velocity data can be used in addition to a note number so as to control a certain value regarding a panel control event. For example, in case of an event of 'TEMPO+' at EC=18, a set value of tempo is controlled not merely in such a manner that the set value of tempo is subjected to simple increment but also in such a manner that the set value of tempo is changed by a value corresponding to the velocity data. Thus, it is possible to realize a more efficient way of adjustment for the setting of the electronic musical instrument as compared to a way of adjustment which is made by merely operating the panel switches.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds are therefore intended to be embraced by the claims.

What is claimed is:

1. An electronic musical instrument comprising:

performance information receiving means for receiving performance information, including tone pitch information, which is transmitted thereto from an external device;

memory means for storing a function to be executed in in a designated correspondence with the tone pitch information;

function executing means for executing the function corresponding to the tone pitch information included in the performance information which is received by the performance information receiving means; and editing means for selectively editing the designated correspondence between the function and the tone pitch information stored by the memory means.

2. An electronic musical instrument comprising:

performance information receiving means for receiving performance information, including tone pitch information, which is transmitted thereto from an external device;

memory means for storing a function to be executed in a designated correspondence with the tone pitch information; and function executing means for executing the function corresponding to the tone pitch information included in the performance information which is received by the performance information receiving means;

wherein the performance information receiving means further comprises a plurality of MIDI channels, at least one of said MIDI channels being arbitrarily selectable to control setting of panel switches which determine said designated correspondence.

3. An electronic musical instrument, which cooperates with a MIDI instrument, comprising:

receiver means having a plurality of MIDI channels which are capable of receiving performance data transmitted from the MIDI instrument;

a keyboard which is used for musical performance;

a plurality of panel switches which are manually operated to designate functions for the keyboard;

memory means for storing information representing a designated correspondence between note numbers, panel control events and the functions;

visual display means for visually displaying content of the information stored by the memory means;

tone-generation means for generating musical tones based on the performance data in response to the information; and editing means for selectively editing the designated correspondence of the information contained in the memory means in response to manual operation of the panel switches in cooperation with the visual display means.

4. An electronic musical instrument according to claim 3 wherein the MIDI channels are divided into a plurality of groups, each of which has a specific function regarding operation of the keyboard.

5. An electronic musical instrument according to claim 3 wherein at least one of the MIDI channels is used to control the panel control event.

6. An electronic musical instrument according to claim 3 wherein the human operator is capable of editing the content of the information such that a panel control event is assigned to a desired note number.

7. An electronic musical instrument according to claim 3 wherein the human operator is capable of editing the content of the information such that a panel control event, together with two functions, are assigned to a desired note number while a manner of execution of the two functions is arbitrarily set.

8. An electronic musical instrument comprising:

performance information receiving means for receiving performance information, including tone pitch information, which is transmitted thereto from an external device, wherein the performance information is divided into a plurality of channels;

control channel detecting means for selecting at least one of the plurality of channels as a control channel, wherein the channel selected is not used for tone generation;

control means for performing virtual operations of panel switches of the electronic musical instrument on the basis of information regarding the control channel; and performance means for generating musical tones based on performance information of the channels which are not selected.

9. An electronic musical instrument according to claim 3 wherein said designated correspondence further comprises a single panel control event assigned to a plurality of note numbers.

10. An electronic musical instrument according to claim 3 wherein said designated correspondence further comprises a plurality of panel control events assigned to a single note number.

11. An electronic musical instrument according to claim 3 wherein one of said panel control events defines an assignment of a particular function to a particular note number.

12. An electronic musical instrument according to claim 3 wherein one of said panel control events defines an assignment of a particular note number to a plurality of functions that are executed in an alternative manner.

13. An electronic musical instrument according to claim 3 wherein one of said panel control events defines an assignment of a particular note number to a particular function that is executed only during key-on events of said particular note number.

* * * * *